United States Patent [19]

Magnusson

[11] Patent Number: 4,524,469

[45] Date of Patent: Jun. 25, 1985

[54] COMBINED FAN AND VALVE

[75] Inventor: Per-Erik Magnusson, V. Frölunda, Sweden

[73] Assignee: Lagerstedt & Krantz AB, Gothenburg, Sweden

[21] Appl. No.: 417,116

[22] PCT Filed: Jan. 18, 1982

[86] PCT No.: PCT/EP82/00006

§ 371 Date: Sep. 8, 1982

§ 102(e) Date: Sep. 8, 1982

[87] PCT Pub. No.: WO82/02568

PCT Pub. Date: Aug. 5, 1982

[30] Foreign Application Priority Data

Jan. 22, 1981 [SE] Sweden ..... 8100360

[51] Int. Cl.[3] ..... E03D 9/02

[52] U.S. Cl. ..... 4/216; 4/213; 98/116; 251/133

[58] Field of Search ..... 4/213, 216; 98/116; 251/133, 351, 357; 137/53

[56] References Cited

U.S. PATENT DOCUMENTS

| | | | |
|---|---|---|---|
| 1,425,903 | 8/1922 | Roth | 98/116 |
| 1,529,711 | 3/1925 | Parrott et al. | 98/116 X |
| 2,098,208 | 11/1937 | Madden et al. | 4/213 |
| 2,615,469 | 10/1952 | Schofield | 251/133 X |
| 3,287,743 | 11/1966 | Coates | 4/216 |
| 3,826,183 | 7/1974 | Rudine | 98/116 |
| 3,888,166 | 6/1975 | Stottmann | 98/116 X |
| 3,942,422 | 3/1976 | Kawai et al. | 98/116 |
| 4,055,113 | 10/1977 | Monroe | 98/116 X |
| 4,133,060 | 1/1979 | Webb | 4/216 |
| 4,244,685 | 1/1981 | Lahtinen | 251/133 X |

FOREIGN PATENT DOCUMENTS

| | | | |
|---|---|---|---|
| 2404805 | 4/1979 | France | 4/213 |
| 2456815 | 2/1982 | France | 4/213 |
| 101361 | 12/1961 | Netherlands | 4/213 |
| 7712305 | 11/1977 | Netherlands | 4/213 |

*Primary Examiner*—Henry K. Artis

*Attorney, Agent, or Firm*—Ziems, Walter & Shannon

[57] ABSTRACT

A combined fan and valve for evacuating air from a space, especially in connection with ventilation of a toilet bowl from odoreous air. The fan wheel (8) of the fan is assembled with a sealing membrane (13). Moreover, the hub 10 of the fan wheel is provided with spindle threads (11) for cooperation with corresponding spindle threads (7) on the output shaft of the drive motor (5). When the motor is started, the fan wheel is lifted from the valve seat and pumps air from the space through the inlet (2) and out through the outlet (3). When the motor stops, the fan wheel will screw itself downwards along the screw (7) under the influence of the gravity in order to bear against the valve seat (4).

2 Claims, 1 Drawing Figure

COMBINED FAN AND VALVE

TECHNICAL FIELD

The present invention relates to the technical field of ventilation means, especially for a water-closet, as described in the Swedish patent specification No. 7904292-5.

BACKGROUND ART

In said patent specification is described a ventilation means for evacuating odorous air from the bowl of the water-closet through an internal fan system for discharging to the sewer pipe of the toilet. The fan system comprises a non-return valve, which however is difficult to construct so that it operates well. The fan system must not be dimensioned so that it produces a too high over-pressure in the sewer pipe. As a matter of fact, it is desirable that the non-return valve should operate at such a small pressure difference as 5 mm of water. For obvious reasons, it is important that the non-return valve has an adequate sealing in the closed position. I have found it difficult to make a satisfactorily operating non-return valve.

More specifically, the present invention relates to a combined fan and valve for evacuating air from a space. The combined fan and valve comprises a housing having an inlet and an outlet and a fan wheel and a drive shaft. By means of the combined fan and valve according to the present invention, the above mentioned problem is solved.

In U.S. Pat. No. 4,133,060, a combined fan and valve is described wherein the fan wheel as well as the valve body are affected by the rotation of the drive shaft. When the shaft rotates, the valve body is lifted from its valve seat by means of a centrifugal device and links. However, this device requires that the shaft rotates in order that the centrifugal device shall lift the valve body. Thus, friction will arise at the connection point between the links and the valve body, which due to the fact that it bears upon the valve seat is immobile, which requires that the drive motor have quite a high starting force. A motor having a low starting force can hardly be used in this construction. Moreover, the link means is a potential source of failure and requires maintenance.

It is an object of the present invention to provide a fan having a valve, which has satisfactory sealing in the closed position, but still can be safely opened for ventilation.

Moreover, it is an object of the invention to provide a ventilation means, which can be driven by a simple and weak low voltage motor without any major power consumption, and which is simple to manufacture, has few integral parts and is simple to maintain.

DISCLOSURE OF THE INVENTION

The above objects are provided according to the invention by means of the fact that the fan wheel is assembled with a sealing membrane for sealing against a valve seat in the housing. Moreover, the fan wheel is provided with threads having a high pitch for cooperation with corresponding threads on the drive shaft. When the drive shaft is standing still, the fan wheel and the sealing membrane are forced against the valve seat. However, when the drive shaft rotates, the fan wheel and the sealing membrane are lifted from the valve seat by means of said threads in order to open the valve and allow the fan to evacuate air from said space.

Preferably, the fan wheel and the sealing membrane are forced to cooperation with the valve seat by means of gravity, but this operation can also be performed or helped by means of a spring. Preferably, said threads are spindle threads having such a high pitch, that the friction forces are overcome by means of gravity, such that the fan wheel is forced, upon the still-standing drive shaft, to the position where the sealing membrane bears against the valve seat.

Eventually, the fan wheel can operate one or several micro switches in at least one of its end positions, for operating other equipment.

BRIEF DESCRIPTION OF THE DRAWINGS

For the purpose of exemplification, a preferred embodiment of the invention is described below with reference to the appended drawings.

BEST MODE FOR CARRYING OUT THE INVENTION AND INDUSTRIAL APPLICABILITY

Figure 1:
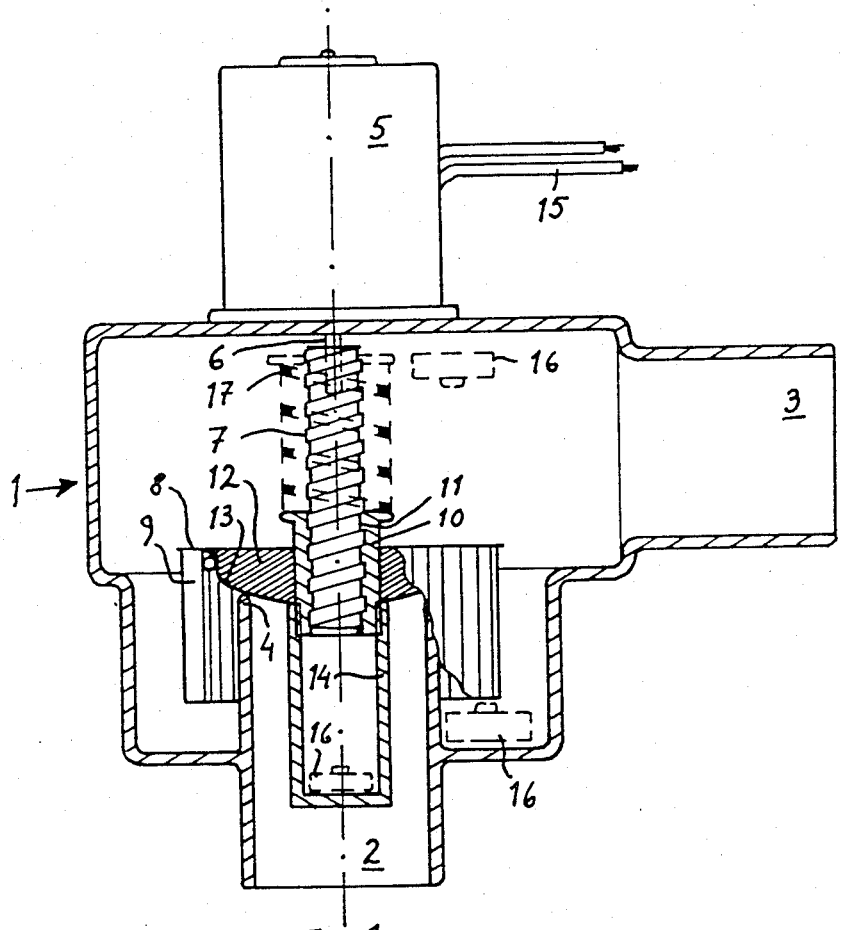
FIG. 1 is a sectional view of the combined fan and valve according to the invention.

The combined fan and valve as shown in FIG. 1 comprises a fan housing 1 having an inlet 2 and an outlet 3. The inlet 2 forms a valve seat 4 in the fan housing. An electric motor 5 of a low-voltage type is adapted at the fan housing, and the drive shaft 6 thereof extends to the interior of the fan housing. At the drive shaft 6, a screw 7 is arranged having spindle threads.

Moreover, the fan housing 1 comprises a fan wheel 8 having several fan blades 9. The fan wheel 8 is of a radial type. The fan wheel comprises a hub 10, which comprises a nut 11 having spindle threads corresponding to the spindle threads of the screw 7. A sealing body 12 having a sealing membrane 13 is attached to the fan wheel 8 between the fan plates 9 and the hub 10. The hub 10 comprises a downwardly closed sleeve 14, which closely clamps the sealing membrane against the hub 10. The sleeve 14 has a length which is sufficient to allow the screw 7 to freely enter the sleeve 14.

The operation of the combined fan and valve will be described below in detail.

In FIG. 1 there is shown the initial position having the drive shaft 6 standing still and the sealing membrane 13 cooperating with the valve seat 4. No air can pass backwards from the outlet 3 to the inlet 2 and the valve normally seals also against air flowing from the inlet 2 to the outlet 3. However, if there is a great pressure difference between the inlet 2 and the outlet 3, the fan wheel 8 will be lifted to a certain extent and pass the air in order to equilibrate the over-pressure.

When the motor 5 is started by means of supplying a voltage through the wires 15, the screw 7 will start to rotate. Since the sealing member 13 bears against the valve seat 14, this fact partly prevents the fan wheel 8 from rotating, which results in that the hub 10 and the nut 11 will screw itself upwards along the screw 7. However, due to the friction between the screw 7 and the nut 11, the fan wheel 8 will start to rotate together with the screw, and air is pumped from the inlet 2 to the outlet 3. The fan wheel 8 positions itself at a certain height along the screw 7 independence of the work performed by the fan wheel 8. If the fan wheel 8 performs hard work, the fan wheel will rise up to the upper end of the screw, but if fan wheel 8 only needs to perform a little work, the fan wheel will be positioned lower along the screw 7. This position is obtained automatically. The power of the motor 5, the pitch of the spindle threads 7 and 11, and the weight of the fan wheel 8 are matched so that the intended operation is achieved.

When the fan wheel 8 rises along the screw 7, the lower end of the screw will enter inside the sleeve 14, which allows this entrance without any obstacle. Not until the fan wheel 8 approaches the upper end of the housing does the lower end of the screw 7 engage the closed end of the sleeve 4 and prevent the fan wheel 8 from reaching the upper wall of the housing.

When the motor 5 stops due to the fact that the supply of electric current through the wires 15 is disconnected, the output shaft 6 and the screw 7 will stop rotating. When the output shaft 6 stands completely still, the fan wheel 8 will continue to rotate downwards along the screw 7 due to the fact that the gravity overcomes the friction in the spindle threads 7 and 11. Finally, the fan wheel reaches the position shown in FIG. 1, whereupon the sealing body 12 and the sealing membrane 13 bear against the valve seat 4 and effect a seal. The sleeve 14 seals against the hub 10 and sealing membrane 13 so that no air can pass through the somewhat leaky spindle threads between the screw 7 and nut 11.

The fan wheel 8 can be adapted to operate micro switches 16 in the lower position and also in the upper position, as is suggested by broken lines in the figure. The sleeve 14 can at its lower end be provided with a micro switch, which disconnects all supply of current to the motor 5 as soon as the screw 7 touches the micro switch, since it is a malfunction if the screw 7 reaches the bottom of the sleeve 14.

The invention can of course be modified and amended in many ways within the scope of the invention. Thus, the radial fan wheel 8 can very well be replaced by an axial fan. The spindle threads in the screw 7 and nut 11 can be right hand threads or left hand threads in dependence of the rotational direction of the motor 5 and the direction of the fan blades.

A spring 17 can be adapted to force the fan wheel 8 to its rest position in order to assist gravity if needed, whereby threads having a smaller pitch can be used. If it be required that the fan wheel is mounted along an horizontal axis, the spring will fully replace gravity.

If a conventional electric motor of a low-voltage type is used, the output shaft 6 will brake quite heavily when the voltage is disconnected. This means that the fan wheel 8 will rotate downwards along the screw 7 due to the fact that the mass forces of the fan wheel 8 tend to maintain its rotation. By this fact the sealing membrane 13 will be moved quite heavily against the seat 4 and a tight seal is obtained.

The combined fan and valve according to the invention can be used in other applications where evacuating of air or gas is required, such as in a kitchen fan, which is driven intermittently. Moreover, the invention can be used for providing air to an oil burner. In this application the micro switches operate the remaining components of the oil burner.

A person skilled in the art realizes that the invention can be modified in many ways within the scope of the invention. The invention is only limited by the appended claims.

I claim:

1. A combined fan and valve suitable for use with a water closet, comprising:

a substantially vertical motor-driven drive shaft having spindle threads; and a fan wheel having an electric sealing membrane attached thereto adapted to seal against a valve seat positioned in the housing and a hub including spindle threads for cooperation with the threads of the drive shaft, the drive shaft threads and the hub threads having a pitch sufficiently large to overcome frictional forces between the drive shaft threads and the hub threads by the force of gravity on said fan wheel when the drive shaft is standing still, whereby said fan wheel and said sealing membrane continue to rotate after the shaft has stopped and move downwardly, screwing said sealing membrane tightly against the valve seat.

2. The combined fan and valve according to claim 1, wherein said drive shaft has a first end and a second end, said fan wheel has a first position adjacent the first end of the drive shaft and a second position adjacent the second end of the drive shaft, and a switch is positioned adjacent one of said fan wheel positions for operation by the fan wheel.

* * * * *